United States Patent [19]

Greiner

[11] 4,125,188

[45] Nov. 14, 1978

[54] STACKABLE STRAPPING FASTENER

[76] Inventor: Alfred Greiner, Konigsberger Strasse 68, D 7302 Ostfildern 2 - Nellingen, Germany

[21] Appl. No.: 737,263

[22] Filed: Nov. 1, 1976

[30] Foreign Application Priority Data

Nov. 7, 1975 [DE] Fed. Rep. of Germany ..... 2549975

[51] Int. Cl.[2] ..... B65D 85/00; B65D 63/06

[52] U.S. Cl. ..... 206/338; 24/23 W; 206/493; 403/405

[58] Field of Search ..... 24/21, 23 W, 30.5 W; 206/338, 340, 348, 493; 403/405

[56] References Cited

U.S. PATENT DOCUMENTS

| | | | |
|---|---|---|---|
| 537,531 | 4/1895 | Ham | 206/340 |
| 1,671,809 | 5/1928 | Briggs | 206/340 X |
| 1,827,315 | 10/1931 | Hallen | 206/340 |
| 2,062,098 | 11/1936 | MacChesney | 206/340 |
| 2,830,344 | 4/1958 | Crosby | 24/23 W |
| 3,180,489 | 4/1965 | McGinn | 206/340 |
| 3,352,414 | 11/1967 | Kuoni | 206/340 |
| 3,553,794 | 1/1971 | Kneidl | 24/23 W |
| 3,722,669 | 3/1973 | Meier et al. | 206/340 |
| 3,722,670 | 3/1973 | Plunkett | 206/340 |
| 3,750,239 | 8/1973 | Styner | 24/23 W |

*Primary Examiner*—Werner H. Schroeder
*Assistant Examiner*—Moshe I. Cohen
*Attorney, Agent, or Firm*—Roylance, Abrams, Berdo & Farley

[57] ABSTRACT

A generally U-shaped body having a central wall and diverging side walls. The end edges of the central wall are notched so that a stack of the bodies can be placed in nesting relationship in a C-shaped magazine and can then be laterally removed, one at a time for use. One side wall is longer than the other and has openings to receive tongs of an applying tool.

3 Claims, 5 Drawing Figures

STACKABLE STRAPPING FASTENER

This invention relates to stackable closure casings or fasteners which are bendable to attach band or strap-like members.

BACKGROUND OF THE INVENTION

It is common practice in securing boxes, crates or the like for shipping to pass a band of metal or plastic material around the outside of the box or case until the distal end of the band is overlapped by another portion thereof, the segment of the band in between the overlapping portions surrounding the container. The band is then placed under tension and the overlapping portions of the band are securely fastened together and the excess band is cut from that portion surrounding the container, leaving a strong and secure attachment to keep the container from opening during the shipping and handling which is to follow. As will be recognized from the following, this invention relates to an attachment device for securing the overlapping portions of the bands to each other.

A closure casing of this general type is known in which the molded or stamped closure is developed with a stop part which has a projection which engages with a recess in the adjacent closure casing in a stack of a plurality of such casings, the recess being provided for the engagement of the projection of the adjacent closure casing in the stack on the other side. The molded part, besides the recesses, also has corresponding projections. A molded part is provided on each of the two lateral walls. The stop connection of two adjacent closure casings, upon insertion of a casing from a magazine into a closing tong, requires a certain expenditure of force in order to release the stop connection.

In the case of another known type of closure casing which in the stacking position can be joined with an adjacent closure casing similarly developed, there is no projection on the other side opposite a recess on the one side so that as tight as possible a connection of two adjacent closure casings can be achieved. It is also known to provide a hole in the middle of the back plate of the closure casing.

BRIEF SUMMARY OF THE INVENTION

An object of the present invention is to provide a closure casing which, without hooking up with another closure casing, can be guided in a magazine in which an entire lateral wall of the closure casing with a part of the rear or central plate thereof protrudes out of the magazine and is therefore free of the magazine.

A further object is to provide a closure and magazine therefor in which each closure has guide means on the narrow lateral edges of the back or central plate thereof so that the stack of closures can be positively guided in a simple magazine which does not occupy much space, and from which each closure casing can be removed from one end of the magazine but not laterally. A recess in the molded part of the longer lateral wall of the closure casing is sufficient for the brief engagement of a cheek of a tong, but prevents interengagement of the closure casings with each other when they are stacked one on top of another.

Briefly described, the invention includes a stackable fastener for connecting parallel adjacent bands or the like comprising a rectangular, planar central wall and first and second rectangular, planar side walls, the central wall having parallel side edges, parallel end edges shorter than the side edges and first and second major faces, the side walls being integrally formed with the central wall and attached to the central wall along the side edges to form a generally U-shaped body, the side walls extending away from the same one of the major faces and diverging away from each other, the first side wall being longer, in the direction of extension away from the central wall, than the other and having a plurality of recesses formed therein, and means for defining guide members on said end edges, the body being placeable adjacent said bands and said side walls being deformable inwardly to a position in which said side walls are generally parallel to said central wall with said second wall overlapping said first wall and in which said walls surround and grip said bands.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
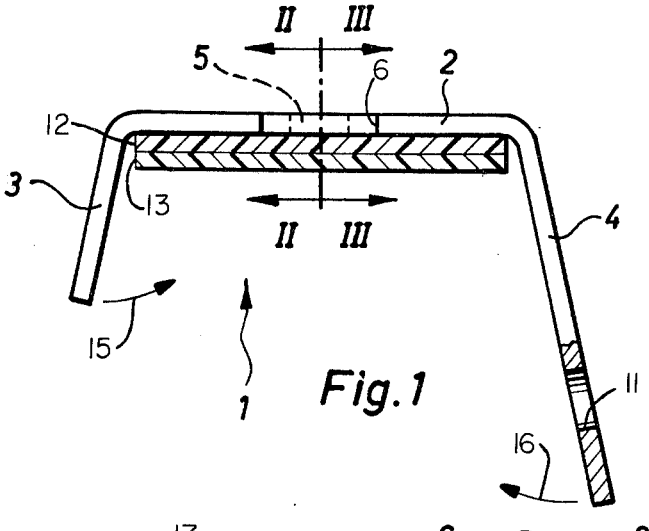
FIG. 1 is an enlarged side elevation of a fastener or closure casing in accordance with the invention, in partial section.
Figure 2:
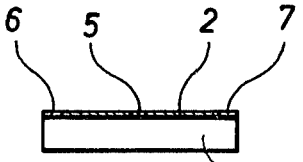
FIG. 2 is a rear elevation, in partial section, along lines II—II of FIG. 1.
Figure 3:
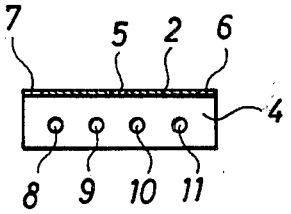
FIG. 3 is a front elevation, in partial section, along lines III—III of FIG. 1.

As shown in FIGS. 1–3, a fastener or closure casing indicated generally at 1 in accordance with the invention includes a rear or central plate or wall 2 which is in the shape, as viewed from the top, of an elongated rectangle with the longer dimension thereof extending perpendicularly to the plane of the paper. Wall 2 has side edges along the longer dimension thereof to which are integrally formed side or lateral walls 3 and 4 which, together with central wall 2, form a one-piece, generally U-shaped body. Walls 3 and 4 extend away from wall 2 in the same direction with respect to one of the major faces of wall 2 and diverge away from each other, the enclosed angle between wall 2 and each of walls 3 and 4 being approximately 102°. The length of side wall 3, in the direction of its extension away from wall 2, is about one-half of the equivalent dimension of wall 4, the length of wall 4 being approximately the same as the width of central wall 2. The fastener thus shown can be made of steel and can be produced by a conventional stamping or punching operation.

In the middle of central wall 2 there is provided a hole 5 which can be used for alignment of a plurality of such fasteners stacked one on top of the other, and for keeping the fasteners together as they are put into a magazine, to be described hereinafter. For this purpose, a relatively rigid connecting wire can be passed through holes 5 in a plurality of fasteners, the wire having a loop at the top or outer end of the uppermost fastener and a temporary retaining member at the lower or inside portion of the bottom one of the stack of fasteners. The temporary retaining device can be, for example, a cylindrical body of rubber or the like having a small hole therethrough which can be pushed onto the distal end of the wire protruding from the bottom fastener to keep the bodies together and guarantee the position and relative orientation of the articles in the stack.

At the middle of the side edges of each fastener there is provided a semi-cylindrical recess extending into the center of each edge. FIG. 1 shows a recess 6 extending inwardly from one edge, this recess and recess 7 at the opposite end being visible in the sectional views of FIGS. 2 and 3. Recesses 6 and 7 permit a stack of the articles in accordance with FIGS. 1 and 3 to be slidably inserted in and retained by a magazine in accordance with FIGS. 4 and 5.

As seen in FIGS. 1 and 3, side wall 4 is provided with four holes 8, 9, 10 and 11 which are circular and which are disposed in a line parallel with and near the distal edge of the side farthest from wall 2. Holes 8–11 are provided to be engaged by fingers provided in a jaw of a tong, which is generally similar to a pair of pliers in that it is provided with opposing jaws, one to engage wall 3 and the other to engage wall 4, for the purpose of bending walls 3 and 4 inwardly in the directions shown by arrows 15 and 16, respectively. As previously indicated, the purpose of the fastener assembly is to secure overlapping portions of straps or bands such as 12 and 13 which are shown in section in FIG. 1 as plastic straps, although these can also be metal or other materials. With the straps placed in the position shown, the remainder of the straps encompassing a container, wall 4 being bent inwardly by the attachment tool, which forms no part of the present invention, and with wall 3 then bent inwardly over wall 4 so that in the resulting applied attachment device, walls 2, 3 and 4 are generally parallel to each other, except for the bent portions interconnecting these walls, to engage and grip the bands 12 and 13 and surround them to form a firm attachment device. As is well known, bands 12 and 13 are disposed around the container and tightened to place them under tension before the attachment device is bent as described. Excess portions of the strap are then severed, leaving the band tightly encircling the container for shipping or other handling.

Figure 4:
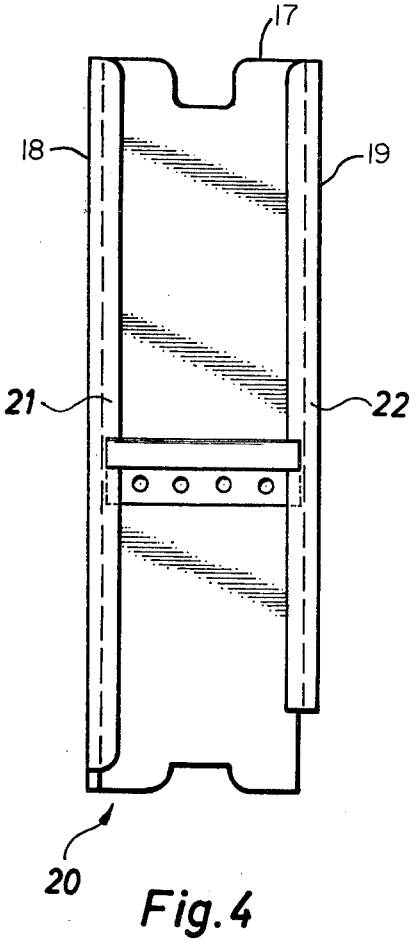
FIG. 4 is a front elevation of a magazine for receiving fasteners of the type shown in FIGS. 1–3.
Figure 5:
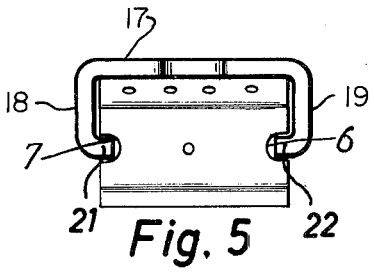
FIG. 5 is a top plan view of the magazine of FIG. 4.

A magazine to receive a stack comprising a plurality of the fasteners of FIGS. 1–3 is shown in FIGS. 4 and 5. The magazine, indicated generally at 20, is generally C-shaped in cross-section and includes a rear wall 17, perpendicularly extending side walls 18 and 19, and inwardly protruding flanges or guide strips 21 and 22 which protrude inwardly from the front edges of walls 18 and 19, the flanges being substantially parallel with wall 17. Wall 17 can be notched at the top and bottom to cooperate with other portions of the mechanism. As seen in FIG. 5, the inwardly protruding guide strips 21 and 22 fit into notches 7 and 6, respectively, of the fastener devices so that the fastener devices can slide longitudinally in the magazine but can only be removed from it in an upward or downward direction.

A stack of fasteners 1 threaded onto a wire as previously described is inserted from above into magazine 20 and the wire is then subsequently removed after extracting the rubber-retaining device from the lower end of the wire. The fasteners 1 are received in such a way by magazine 20 that the magazine surrounds the rear portion of the stack of fasteners including walls 4 with the other portion thereof, including wall 3 and the forward half of wall 2 being exposed in front of the magazine. It will be observed that wall 19 and guide strip 22 are shorter than wall 18 and guide strip 21 to permit lateral removal of the fasteners, individually, from the lower end of the magazine.

It will be observed that instead of guide notches 6 and 7, guide projections can alternatively be provided to mate with suitably recessed guide strips for the purpose of holding the closure casings in substantially the same way as described in connection with the magazine 20 shown in FIGS. 4 and 5. It is significant, however, that the projections extend laterally from the ends of the fasteners rather than protruding in such a way that the fasteners interengage with each other in the stack.

While certain advantageous embodiments have been chosen to illustrate the invention, it will be understood by those skilled in the art that various changes and modifications can be made therein without departing from the scope of the invention as defined in the appended claims.

What is claimed is:

1. A stackable fastener for connecting parallel adjacent bands or the like comprising
   - a rectangular, planar central wall and first and second rectangular, planar side walls,
     - said central wall having parallel side edges, parallel end edges shorter than said side edges and first and second major faces,
     - said side walls being integrally formed with said central wall and attached to said central wall along said side edges to form a generally U-shaped body;
     - said side walls extending away from the same one of said major faces and diverging away from each other,
     - said first side wall being longer, in the direction of extension away from said central wall, than said second wall and having a plurality of holes formed therein and spaced along and adjacent to the distal edge thereof; and
   - means for defining guide members on said end edges of said central wall, said guide members comprising inwardly extending recesses centrally located in said end edges;
   - said body being placeable adjacent said bands and said side walls being deformable inwardly to a position in which said side walls are generally parallel to said central wall with said second wall overlapping said first wall and in which said walls surround and grip said bands.

2. The combination including a plurality of stackable fasteners for connecting parallel adjacent bands and a magazine for retaining said fasteners comprising
   - a plurality of fastener bodies each comprising
     - a rectangular, planar central wall and first and second rectangular, planar side walls,
     - said central wall having parallel side edges, parallel end edges shorter than said side edges and first and second major faces,
     - said side walls being integrally formed with said central wall and attached to said central wall along said side edges to form a generally U-shaped body;
     - said side walls extending away from the same one of said major faces and diverging away from each other,
     - means for defining inwardly extending guide recesses in said end edges of said central wall;
     - said body being placeable adjacent said bands and said side walls being deformable inwardly to a position in which said side walls are generally parallel to said central wall with said second wall overlapping said first wall and in which said walls surround and grip said bands;
   - and said magazine comprising an elongated member which is generally C-shaped in cross-section and having an elongated back wall having side edges, side walls extending parallel to each other from said side edges of said back wall and flanges extending parallel to said back wall toward each other from said side walls, said flanges having parallel distal edges spaced apart to engage said guide recesses in said bodies, whereby a plurality of said bodies in nested relationship are insertable into said magazine and movable in a direction parallel with said back wall and said distal edges.

3. The combination according to claim 2 wherein one of said side walls of said magazine and the flange extending therefrom is shorter than the other side wall and flange in a direction parallel to the longitudinal axis of said magazine.

* * * * *